United States Patent [19]

Peterson, Jr.

[11] 4,128,291

[45] Dec. 5, 1978

[54] FUSE ADAPTER TERMINAL

[76] Inventor: Richard J. Peterson, Jr., 372 Burnet Pl., Paramus, N.J. 07652

[21] Appl. No.: 851,854

[22] Filed: Nov. 16, 1977

[51] Int. Cl.[2] ..... H01H 85/22

[52] U.S. Cl. ..... 339/154 A; 337/215; 339/258 F

[58] Field of Search ..... 339/150 F, 154 R, 154 A, 339/219 F, 252 F, 253 F, 256 C, 258 F, 259 F, 262 F; 337/209, 215

[56] References Cited

U.S. PATENT DOCUMENTS

| | | | |
|---|---|---|---|
| 1,641,203 | 9/1927 | Scordamaglia | 337/215 |
| 3,478,307 | 11/1969 | Testo | 337/215 |

FOREIGN PATENT DOCUMENTS

| | | | |
|---|---|---|---|
| 901362 | 7/1962 | Fed. Rep. of Germany | 339/258 S |

*Primary Examiner*—Neil Abrams
*Attorney, Agent, or Firm*—Robert A. Maikis

[57] ABSTRACT

Fuse adapter terminals are provided for fuse holders of the type having a pair of spaced-apart spring clips which receive the ends of a cylindrical fuse. The basic adapter terminal comprises a substantially U-shaped member of electrically-conductive, resilient material which has two legs which are joined by an outwardly-curved central portion. Each leg has a first outwardly-curved lobe which is adjacent the central portion and which cooperates therewith to form an arcuate surface which is disposed in one of the fuse holder spring clips. Each leg also has a second outwardly-curved lobe which is adjacent the free end of the leg. The second lobes are oppositely disposed and cooperate with each other to receive one end of the fuse therebetween so that when a pair of the basic adapter terminals are utilized, each end of the fuse is mechanically supported by and electrically connected to the spring clip associated therewith. An outwardly-extending tab which is shaped as a male spade connector is provided on the free end of at least one of the legs of one of the basic terminals to receive a female connector thereon. The tab functions as an auxiliary terminal to permit connection of an auxiliary circuit to the fuse adapter terminal. When both legs of the adapter terminal are provided with such tabs, each adapter terminal provides connections for two auxiliary circuits.

6 Claims, 8 Drawing Figures

FUSE ADAPTER TERMINAL

BACKGROUND OF THE INVENTION

1. Field of the Invention

This invention relates to electrical connectors and more particularly to a fuse adapter terminal which permits auxiliary circuits to be connected to fuse holders of the type having a pair of spaced-apart spring clips which receive the ends of cylindrical fuses.

2. Description of the Prior Art

Fuse blocks are usually employed in equipment, such as motor vehicles, for example, where a single source of electrical energy is employed to energize a number of different load circuits. The fuse block contains a fuse holder for each of the load circuits in the vehicle. Each fuse holder comprises a pair of spaced-apart spring clips which function as electrical terminals. One clip of each fuse holder is connected to the vehicle generator and/or battery while the other clip is connected to the load circuit being energized. The fuses which are customarily employed comprise a circular cylindrical glass envelope containing a metal fuse element which is connected to circular cylindrical metal caps which seal the ends of the envelope. The metal end caps of the fuse are concentrically disposed within the metal spring clips so that the ends of each fuse are both mechanically supported by and electrically connected to the spring clips.

The fuse blocks in present-day motor vehicles generally are designed to accomodate only a limited number of load circuits. The number of circuits or fuses is usually determined by the standard electrical equipment on the vehicle and the number of optional electrical accessories available from the manufacturer or dealer. It frequently happens, however, that the owner of the vehicle decides to add additional electrical equipment and finds that there are no fuse holders available for making the electrical connection between the new equipment and the vehicle power supply. For example, when the vehicle owner purchases citizen's band radio equipment, the CB unit must be connected to the vehicle generator and/or battery. The CB unit is usually provided with a power lead which may or may not be separately fused. This lead is often provided with a standard female electrical connector which is intended to be used with the male spade connectors found on the vehicle fuse blocks. When all of the fuse holders of the fuse block are being utilized for existing vehicle equipment, the CB owner must improvise an electrical connection which usually involves stripping wires and making a soldered or spliced connection.

In order to avoid this problem, so-called fuse adapter terminals are utilized to permit the female connector of the auxiliary circuit to be connected directly to one of the fuse holders in the fuse block. In one known type of fuse adapter terminal, a substantially U-shaped "cap" of electrically conductive, resilient material is placed on top of one of the spring clips in the fuse holder. The cap is designed to enclose the free ends of the spring clip and each leg of the cap is provided with a detent which engages the projecting tab on the ends of the spring clip to lock the cap in place. This type of adapter terminal suffers from the disadvantage that the adapter terminal itself must be removed from the spring clip of the fuse holder each time that the fuse is replaced. In another known type of fuse adapter terminal, a male spade connector having a curved "ear" or projection on one end thereof is inserted between the metal end cap of the fuse and one side of the spring clip. The curved ear of the adapter terminal is held in place by the frictional contact between the fuse cap and the one side of the spring clip. Accordingly, this arrangement suffers from the disadvantage that the adapter terminal falls out of place when the fuse is removed and consequently must be replaced each time the fuse is replaced.

SUMMARY OF THE INVENTION

It is an object of this invention to provide a fuse adapter terminal for fuse holders of the type having a pair of spaced-apart spring clips wherein removal or replacement of the fuse in the holder does not require removal or replacement of the fuse adapter terminal.

It is a further object of this invention to provide a fuse adapter terminal for fuse holders of the type having a pair of spaced-apart spring clips wherein the adapter terminal is firmly seated within the spring clip and will not fall out during replacement of the fuse.

It is a still further object of this invention to provide a fuse adapter terminal for fuse holders of the type having a pair of spaced-apart spring clips wherein large surface areas of the adapter terminal are in physical contact with the fuse and the spring clip to thereby provide excellent electrical and mechanical connections between the fuse and the spring clip.

It is an additional object of this invention to provide a fuse adapter terminal for fuse holders of the type having a pair of spaced-apart spring clips wherein the fuse adapter terminal is easily installed and removed.

It is another object of this invention to provide a fuse adapter terminal for fuse holders of the type having a pair of spaced-apart spring clips wherein each adapter terminal may provide electrical connections for as many as two auxiliary circuits.

Briefly, the fuse adapter terminal of the invention comprises a substantially U-shaped member of electrically-conductive, resilient material. The member has a pair of oppositely-disposed leg portions and an outwardly-extending arcuate central portion joining one end of each of the leg portions. Each of the leg portions has first and second outwardly-extending lobes disposed along the length thereof with the first lobes of the leg portions being adjacent said arcuate central portion and cooperating therewith to form an arcuate surface which is adapted to be disposed in a spring clip of the fuse holder. The second lobes of the leg portions are adjacent the other end of the leg portions and cooperate with each other to receive the end of the fuse therebetween so that the ends of the fuse are mechanically supported by and electrically connected to the spring clips of the fuse holder. An outwardly-extending tab is provided on the other end of at least one of the leg portions. The tab is shaped as a male spade connector and has a length sufficient to receive a female connector thereon so that the tab functions as an auxiliary terminal to permit connection of an auxiliary circuit to the fuse holder. If desired, the tab may be tapered and provided with an aperture to permit connection of a detent type of female connector thereto. A second outwardly-extending tab may be provided on the other end of the other of the leg portions and the second tab may also be shaped as a male spade connector so that the second tab also functions as an auxiliary terminal to thereby permit connection of two auxiliary circuits to the same adapter terminal.

The nature of the invention and other objects and additional advantages thereof will be more readily understood by those skilled in the art after consideration of the following detailed description taken in conjunction with the accompanying drawing.

DESCRIPTION OF THE PREFERRED EMBODIMENT OF THE INVENTION

Figure 1:
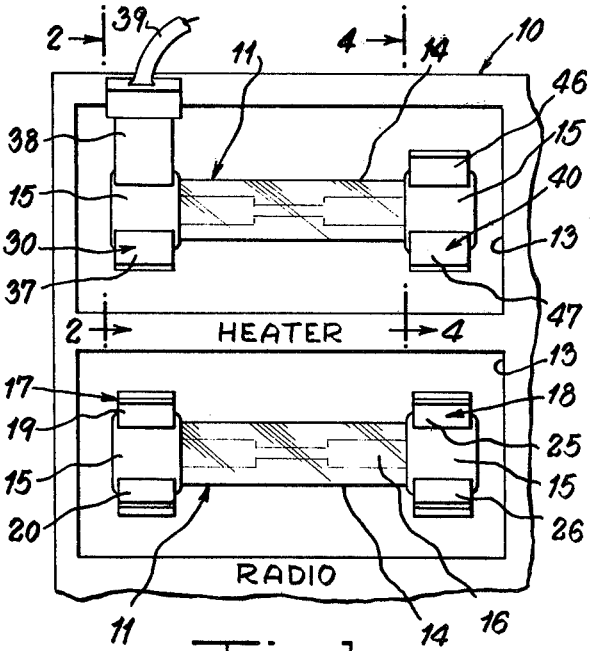
FIG. 1 is a front elevational view of a portion of a motor vehicle fuse block having separately fused heater and radio circuits showing fuse adapter terminals constructed in accordance with the teachings of the present invention employed in the spring clips of the heater circuit and a female connector connected to the auxiliary terminal of one of the adapter terminals.

Referring now to FIG. 1 of the drawing, there is shown a portion of a fuse block 10 of the type which is commonly employed in motor vehicles and the like for electrical distribution purposes. The fuse block provides separately fused circuits for the vehicle heater and the vehicle radio and for other (not illustrated) electrical equipment of the vehicle. Each circuit of the fuse block 10 is provided with its own fuse, indicated generally as 11, and a fuse holder therefor which are disposed in individual recessed portions 13 of the fuse block. Each of the fuses 11 is of a well known, commercially-available type which comprises a circular cylindrical glass envelope 14 and circular cylindrical metal end caps 15. The end caps 15 are electrically connected to the ends of a fuse element 16 which is disposed within the glass envelope 14.

Figure 2:
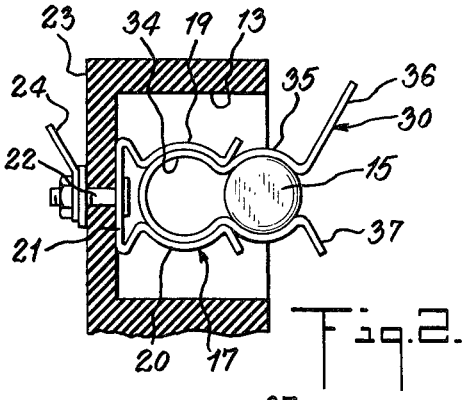
FIG. 2 is a full sectional view taken along the line 2—2 of FIG. 1 of the drawing showing one of the fuse adapter terminals with the female connector removed.
Figure 4:
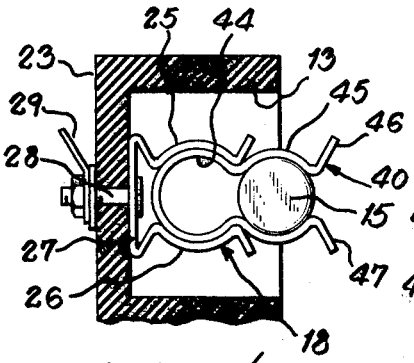
FIG. 4 is a full sectional view taken along the line 4—4 of FIG. 1 of the drawing showing the other fuse adapter terminal.

The fuse holder for each fuse is of a known, commercially-available type which comprises a pair of spaced-apart spring clips indicated generally as 17 and 19. As seen in FIG. 2 of the drawing, the spring clip 17 comprises a pair of outwardly-curved legs 19 and 20 which are joined at one end thereof by a flat central portion 21. The central portion 21 is secured by any convenient means, such as the bolt 22 illustrated, for example, to the back 23 of the fuse block 10. The bolt 22 also serves to electrically connect the spring clip 17 to a male spade connector 24 which is connected by a lead (not shown) to the generator and/or battery power source of the vehicle. The spring clip 17 is fabricated of an electrically-conductive, resilient material so that the legs 19 and 20 may be spread apart to receive an end cap 15 of the fuse 11 therebetween. The construction of spring clip 18 is identical to the construction of spring clip 17 and is shown in FIG. 4 of the drawing as comprising legs 25 and 26, central portion 27, and a bolt 28 which electrically connects the spring clip to a male spade connector 29 on the back 23 of the fuse block. The spade connector 29 may be connected by a lead (not shown) to the vehicle load circuit which is served by the particular fuse involved.

From the foregoing description it is apparent that the end caps 15 of the fuses 11 are physically supported by and electrically connected to the spring clips 17 and 18 of each fuse holder so that each fuse is electrically connected between the spade connector terminals 24 and 29 for each circuit of the fuse block. As mentioned previously, since the fuse block 10 is provided with a fixed number of circuits or fuse holders, it frequently happens that no electrical terminals are available for the connection of auxiliary electrical circuits or equipment which are added to the vehicle after manufacture. When this occurs, the fuse adapter terminals of the present invention may be employed to provide one or more auxiliary terminals which permit easy connection of any auxiliary equipment which may be added.

Figure 3:
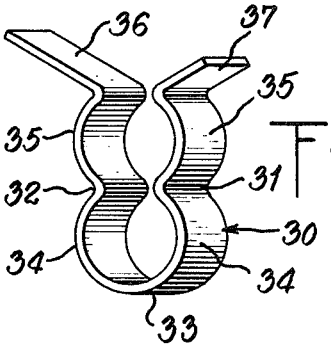
FIG. 3 is a perspective view of the fuse adapter terminal of FIG. 2 which is employed to make the connection to the auxiliary circuit.

As seen in FIGS. 1, 2 and 3 of the drawing, a fuse adapter terminal, indicated generally as 30, is inserted in the spring clip 17 for the "Heater" fuse block circuit to provide an auxiliary terminal for energizing an auxiliary circuit. The fuse adapter terminal 30 is seen to comprise a substantially U-shaped member which has a pair of oppositely-disposed leg portions 31 and 32 which are joined at one end thereof by an outwardly-extending arcuate central portion 33. Each of the leg portions 31 and 32 is provided with a first outwardly-extending lobe 34 which is disposed adjacent the arcuate central portion 33 and which cooperates therewith to form a segment of a cylindrical surface which is adapted to be disposed between the legs 19 and 20 of the spring clip 17 as shown in FIG. 2. Each of the leg portions 31 and 32 is also provided with a second outwardly-extending lobe 35 which is disposed adjacent the other end of the leg portion. The lobes 35 cooperate with each other to receive the cylindrical end cap 15 of the fuse therebetween.

When the end caps of the fuse are circular cylindrical in shape, the lobes 35 are shaped as segments of a circular cylinder so that the fuse end cap 15 is concentrically disposed within the lobes 35. Similarly, when the legs 19 and 20 of the spring clip 17 are shaped as segments of a circular cylinder, the lobes 34 and the central portion 33 of the adapter terminal are also shaped as segments of a circular cylinder so that the closed end of the adapter terminal may be concentrically disposed within the legs 19 and 20 of the spring clip 17. It will be understood, however, that when the end caps of the fuse and the legs of the spring clips are shaped other than as circular cylindrical surfaces, the lobes 34 and 35 and the central portion 33 of the adapter terminal may be shaped as segments of cylindrical surfaces having the same degree of curvature as the fuse caps and spring clip legs to thereby assure maximum surface contact areas between the fuse end caps and the adapter terminal and between the spring clips and the adapter terminal for good electrical conductivity. The fuse adapter terminal 30 should be fabricated of an electrically-conductive, resilient material, such as brass, for example, so that the leg portions 31 and 32 may be spread apart to receive the fuse end caps 15 therebetween and to assure good electrical conductivity for the connection. The other or "free" ends of the leg portions 31 and 32 are provided with outwardly-extending tabs 36 and 37 which serve to guide the end cap 15 of the fuse into engagement with the lobes 35 to facilitate insertion of the fuse into the fuse adapter terminal. One of these tabs, the tab 36, is shaped as a male spade connector and is elongated to have a length which is sufficient to receive a female connector 38 thereon as shown in FIG. 1 of the drawing. The female connector 38 is of well known construction and is crimped or soldered to the end of a lead 39 which is connected to the auxiliary circuit to be energized.

Figure 5:
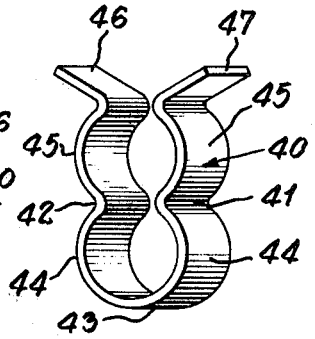
FIG. 5 is a perspective view of the fuse adapter terminal shown in FIG. 4 of the drawing.

When the fuse adapter terminal 30 is inserted into the spring clip 17 and the fuse is placed between lobes 35 of the terminal, the fuse is displaced outwardly away from the back 23 of the fuse block, so that it is desirable to employ a fuse adapter terminal 40 in the spring clip 18 to keep the fuse in alignment with the spring clips. As seen in FIGS. 4 and 5 of the drawing, the adapter terminal 40 is basically the same as the adapter terminal 30 and comprises leg portions 41 and 42 and an arcuate central portion 43. Each of the leg portions 41 and 42 is provided with first and second lobes 44 and 45 which are shaped in the same manner as the lobes 34 and 35 of the adapter terminal 30. Again, outwardly-extending tabs 46 and 47 are provided on the other end of the leg portions 41 and 42 to guide the fuse end cap 15 between the lobes 45 during insertion of the fuse. Since the tabs 46 and 47 are not utilized as auxiliary terminals for connection to auxiliary circuits, they are of the same length and need not be long enough to receive a female connector thereon. If desired, the tabs 46 and 47 may be eliminated completely since their principal functions are to facilitate insertion of the fuse into the adapter terminal and to facilitate insertion of the adapter terminal into the spring clip of the fuse holder. Similarly, in the adapter terminal 30 which is employed in spring clips 17, the tab 37 may be eliminated if desired. The tab 36, however, must be retained since this functions as the auxiliary terminal for connection to the auxiliary circuit. In all other respects, however, the fuse adapter terminal 40 may be identical in construction and material to the fuse adapter terminal 30.

It is apparent from the foregoing description that the fuse adapter terminals 30 and 40 of the invention serve to mechanically support the fuse end caps 15 and to electrically connect the end caps to the spring clips associated therewith. Since the lobes 34 and 44 of the adapter terminals are seated between the legs of the spring clips and the fuse end caps are seated between the lobes 35 and 45, it is apparent that the fuse may be removed or inserted without removing the fuse adapter terminals. Accordingly, once the fuse adapter terminals are inserted, they need not be removed again for fuse replacement. The unique double lobe arrangement of the leg portions of each of the fuse adapter terminals provides maximum areas of surface contact between the fuse end caps and the adapter terminal and between the adapter terminal and the spring clips of the fuse holder to thereby provide both good mechanical support for the fuse and maximum electrical conductivity for the fuse holder.

Figure 6:
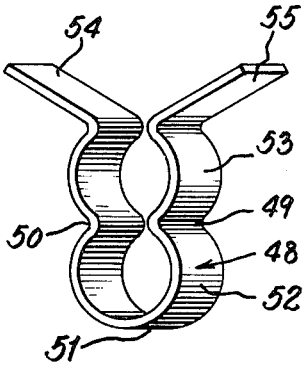
FIG. 6 is a perspective view of a fuse adapter terminal constructed in accordance with the teachings of the present invention which may be utilized to make connections to two auxiliary circuits.

The unique construction of the fuse adapter terminal of the invention permits each adapter terminal to provide up to two auxiliary terminals, so that each adapter terminal may energize as many as two auxiliary circuits. As seen in FIG. 6 of the drawing, an adapter terminal, indicated generally as 48, which may be employed for this purpose has the same basic construction as the adapter terminals 30 and 40. This adapter terminal comprises leg portions 49 and 50 and an arcuate central portion 51. The lobes 52 and 53 of each leg portion are shaped in the same manner as the corresponding lobes on adapter terminals 30 and 40 and serve the same functions. In the adapter terminal 48, however, tabs 54 and 55, which are provided at the other or free end of the leg portions, are each shaped as a male spade connector and each has a length sufficient to receive a female connector thereon, so that each of the tabs 54 and 55 functions as an auxiliary terminal to permit a total of two auxiliary circuits to be connected to the same spring clip of the fuse holder.

Figure 7:
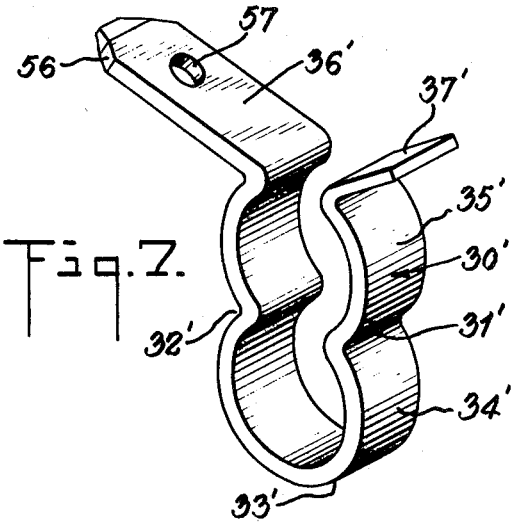
FIG. 7 is a perspective view of a fuse adapter terminal constructed in accordance with the teachings of the present invention having a male spade connector which has been modified to receive a female connector of the detent type.

FIG. 7 of the drawing shows a fuse adapter terminal of the invention which has been modified to receive a female connector of the detent type. In describing this embodiment of the invention, reference numerals with a prime notation will be employed to describe elements which are similar to or the same as the correspondingly numbered elements in the embodiment of FIGS. 2 and 3 of the drawing. As seen in FIG. 7, the modified fuse adapter terminal 30' has the same shape and construction as the fuse adapter terminal 30 with the exception that the elongated tab 36', which functions as the male spade connector terminal, is tapered at the free end 56 thereof and is provided with an aperture 57 which passes through the tab 36'. This construction of the male spade connector tab permits it to act as an auxiliary terminal which is capable of connection to a female connector of the detent type. The construction of female connectors of the detent type is well known and will not be described herein except to note that the female connector is provided with a small projection or "finger" which engages the aperture 57 in the tab 36' when the female connector slides into place on the tab 36', so that a detent or locking mechanism is provided to keep the male and female connectors engaged. The tapered end 56 of the tab 36' is employed to facilitate insertion of the male spade connector tab 36' into the female connector.

Figure 8:
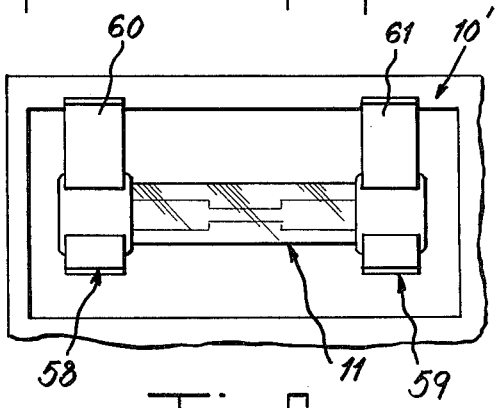
FIG. 8 is a front elevational view of a portion of a fuse block showing a single fuse holder having fuse adapter terminals constructed in accordance with the teachings of the present invention disposed in the spring clips so that a connection to an auxiliary circuit may be made from each spring clip.

FIG. 8 of the drawing shows a portion of a fuse block 10' of the same construction as fuse block 10 in FIG. 1 of the drawing wherein fuse adapter terminals 58 and 59 are employed in the spring clips of the fuse holder. The fuse adapter terminals 58 and 59 are each identical in construction to the fuse adapter terminal 30 shown in FIGS. 2 and 3 and each provides a single auxiliary terminal for connection to an auxiliary circuit. The auxiliary terminal 60 of the fuse adapter terminal 58 may be connected to one auxiliary circuit while the auxiliary terminal 61 of fuse adapter terminal 59 may be connected to another auxiliary circuit. If desired, either or both of the fuse adapter terminals 58 and 59 could be replaced by a fuse adapter terminal of the type shown in FIG. 6 of the drawing which provides two auxiliary terminals on a single fuse adapter terminal, so that a total of three or even four auxiliary circuits may be energized from the two spring clips of a single fuse holder.

When a fuse adapter terminal having either one or two auxiliary terminals thereon is employed, it is usually inserted into the fuse holder spring clip which is connected to the vehicle power supply if the auxiliary circuit to be energized is provided with its own separate fuse holder. For example, CB radio equipment is often sold with a separate fuse holder in the lead which is intended to be connected to the vehicle power supply. In this case, the CB lead would be connected to an auxiliary terminal on the fuse adapter terminal which is inserted in the spring clip which is directly connected to the vehicle power supply since the CB circuit is protected by its own fuse. If the auxiliary circuit or equipment is not provided with its own separate fuse, it is preferable to connect it to an auxiliary terminal of a fuse adapter terminal which is inserted in the spring clip which is not connected to the vehicle power supply, so that the auxiliary circuit is connected to the output side of the fuse and is thereby protected to some extent by the fuse in the fuse holder. Accordingly, the number and use of fuse adapter terminals of the invention employed in a given application will vary with the type and construction of the auxiliary equipment to be added to the vehicle electrical system.

It is believed apparent that many changes could be made in the construction and described uses of the foregoing fuse adapter terminals and many seemingly different embodiments of the invention could be constructed without departing from the scope thereof. Accordingly, it is intended that all matter contained in the above description or shown in the accompanying drawing shall be interpreted as illustrative and not in a limiting sense.

What is claimed is:

1. A fuse adapter terminal for fuse holders of the type having a pair of spaced-apart spring clips which are adapted to receive the ends of a cylindrical fuse comprising a substantially U-shaped member of electrically-conductive resilient material, said member having a pair of oppositely-disposed leg portions, an outwardly-extending arcuate central portion joining one end of each of said leg portions, and an outwardly-extending male spade connector on the other end of one of said leg portions for receiving a female connector thereon, each of said leg portions having first and second outwardly-extending lobes disposed along the length thereof, the first lobes of said leg portions being adjacent said arcuate central portion and cooperating therewith to form an arcuate surface which is adapted to be disposed in a spring clip of the fuse holder, the second lobes of said leg portions being adjacent the other end of the leg portions and cooperating with each other to receive the end of the fuse therebetween, whereby the ends of the fuse are mechanically supported by and electrically connected to the spring clips of the fuse holder and said male spade connector functions as an auxiliary terminal to permit connection of an auxiliary circuit to the fuse holder.

2. A fuse adapter terminal as claimed in claim 1 wherein said first lobes of said leg portions and said arcuate central portion are segments of a circular cylinder so that said arcuate surface is a segment of a circular cylindrical surface which is adapted to be concentrically disposed in the spring clip, and said second lobes of said leg portions are segments of a circular cylinder so that the end of the fuse is concentrically disposed therebetween.

3. A fuse adapter terminal as claimed in claim 2 wherein a second outwardly-extending male spade connector is provided on said other end of the other of said leg portions for receiving a second female connector thereon, so that said second male spade connector also functions as an auxiliary terminal to permit connection of a second auxiliary circuit to the fuse holder.

4. A fuse adapter terminal as claimed in claim 1 wherein said male spade connector is tapered and is provided with an aperture to permit connection of a detent type of female connector thereto.

5. A fuse adapter terminal as claimed in claim 1 wherein a second outwardly-extending male spade connector is provided on said other end of the other of said leg portions for receiving a second female connector thereon, so that said second male spade connector also functions as an auxiliary terminal to permit connection of a second auxiliary circuit to the fuse holder.

6. A fuse adapter terminal as claimed in claim 1 wherein a short outwardly-extending tab is provided on said other end of the other of said leg portions to guide the end of the fuse into engagement with said second lobes.

* * * * *